United States Patent [19]

Goda et al.

[11] Patent Number: 4,753,868

[45] Date of Patent: Jun. 28, 1988

[54] PROCESS FOR PROCESSING SILVER HALIDE COLOR PHOTOGRAPHIC MATERIAL CONTAINING SENSITIZING DYE(S) AND BLEACH-FIXING WITH A HIGH LEVEL OF IODIDE IONS

[75] Inventors: Kensuke Goda; Akio Mitsui, both of Kanagawa, Japan

[73] Assignee: Fuji Photo Film Co., Ltd., Kanagawa, Japan

[21] Appl. No.: 35,337

[22] Filed: Apr. 7, 1987

Related U.S. Application Data

[63] Continuation-in-part of Ser. No. 774,789, Sep. 11, 1985, abandoned.

[30] Foreign Application Priority Data

Sep. 11, 1984 [JP] Japan ..... 59-190174

[51] Int. Cl.[4] ..... G03C 5/38; G03C 7/00; G03C 1/08; G03C 7/26

[52] U.S. Cl. ..... 430/393; 430/377; 430/460; 430/461; 430/505; 430/543; 430/556; 430/583; 430/585; 430/588

[58] Field of Search ..... 430/393, 377, 585, 583, 430/588, 505, 543, 460, 461, 556

[56] References Cited

U.S. PATENT DOCUMENTS

| | | | |
|---|---|---|---|
| T910002 | 1/1973 | Hotter | 430/393 |
| 3,446,619 | 5/1969 | Gilman et al. | 430/377 |
| 3,506,443 | 4/1970 | Motter | 430/377 |
| 3,942,984 | 3/1976 | Heilmann | 430/393 X |
| 4,040,839 | 8/1977 | Matsuyama et al. | 430/377 |
| 4,444,873 | 4/1984 | Ishikawa et al. | 430/461 X |
| 4,508,817 | 4/1985 | Ohno et al. | 430/460 X |
| 4,518,680 | 5/1985 | Koboshi et al. | 430/393 |
| 4,524,128 | 1/1985 | Edwards et al. | 430/583 X |
| 4,563,405 | 1/1986 | Ishikawa et al. | 430/393 X |

FOREIGN PATENT DOCUMENTS

| | | | |
|---|---|---|---|
| 3013418 | 2/1978 | Japan | 430/393 |

*Primary Examiner*—Mukund J. Shah

*Attorney, Agent, or Firm*—Sughrue, Mion, Zinn, Macpeak and Seas

[57] ABSTRACT

A process for processing a silver halide color photographic material is described, comprising developing an imagewise exposed light-sensitive material and then bleach-fixing it, wherein the light-sensitive material contains at least one sensitizing dye selected from three particular types of sensitizing dye compounds, and a bleach-fixing solution contains iodide ions in an amount exceeding $1.2\times10^{-3}$ gram ion per liter of solution.

14 Claims, No Drawings

PROCESS FOR PROCESSING SILVER HALIDE COLOR PHOTOGRAPHIC MATERIAL CONTAINING SENSITIZING DYE(S) AND BLEACH-FIXING WITH A HIGH LEVEL OF IODIDE IONS

CROSS-REFERENCE TO RELATED APPLICATION

The present application is a continuation-in-part of U.S. application Ser. No. 774,789, filed Sept. 11, 1985, now abandoned, in the names of Kensuke Goda and Akio Mitsui and entitled PROCESS FOR PROCESSING SILVER HALIDE COLOR PHOTOGRAPHIC MATERIAL.

FIELD OF THE INVENTION

The present invention relates to a silver halide color photographic material. More particularly, it is concerned with a process for processing a silver halide color photographic material (hereinafter also referred to more simply a "light-sensitive material"), in which bleaching and fixation are carried out at the same time, i.e., a combined bleaching and fixing process is employed, and the bleaching speed is improved.

BACKGROUND OF THE INVENTION

The basic steps for processing light-sensitive materials are generally color development and de-silvering. In the color developing step, exposed silver halide is reduced by the action of a color developing agent, thereby forming silver, while at the same time the oxidized color developing agent reacts with a coupler, thereby providing a dye image. In the subsequent de-silvering step, the silver formed during the color developing step is oxidized by the action of an oxidizing agent (generally called a "bleaching agent"), and thereafter dissolved by a silver ion-complexing agent generally called a "fixing agent". After the de-silvering step, the dye image alone is present in the light-sensitive material.

The de-silvering process can be carried out in two manners. One is to use two baths, i.e., a bleaching bath containing a bleaching agent, and a fixing bath containing a fixing agent. The other is to carry out the de-silvering using a single bath, i.e., a bleach-fixing bath containing both the bleaching agent and fixing agent.

In practice, the photographic processing includes, as well as the above basic steps, various auxiliary steps for the purpose of, for example, providing desirable photographic and physical properties, or improving the storage stability of the images. Typical examples include a hardening bath, a stopping bath, an image-stabilizing bath, and a washing bath.

In general, as bleaching agents, red prussiate, dichromic acid salts, ferric chloride, aminopolycarboxylic acid/iron (III) salts, and persulfuric acid salts are known.

These compounds, however, have some disadvantages. Red prussiate and dichromic acid salts tend to cause pollution problems, because they contain cyan and hexavalent chromium. Therefore, the use of such compounds requires special equipment for the treatment thereof. Ferric chloride produces iron hydroxide in the subsequent washing step and causes the formation of stain; therefore, it is not totally satisfactory. Persulfuric acid salts are very poor in the bleaching action and thus have a disadvantage in that a considerably long period of time is required for the bleaching step. In order to improve this poor bleaching activity, it has been proposed to use a bleach-accelerating agent in combination. However, the persulfuric acid salts themselves are defined as "dangeous material" according to the Fire Fighting Regulations and is required to apply various treatments for the storage thereof. Thus they are not totally satisfactory.

Aminopolycarboxylic acid/iron (III) complex salts (particularly an ethylenediaminetetraacetic acid/iron (III) complex salt) are now most widely used as bleaching agents, because they cause less pollution problems and are free from the problem of poor storage stability as is encountered in the case of persulfuric acid salts. These complex salts, however, are not always sufficiently satisfactory in bleaching power. Thus, only in the case that they are used in bleaching or bleach-fixing of a low sensitivity silver halide color material using mainly a silver chlorobromide emulsion, can the desired object be completely satisfactorily attained. In processing, however, a high sensitivity light-sensitive material which uses mainly a silver chlorobromoiodide or silver iodobromide emulsion and is color sensitized, particularly a color reversal light-sensitive material for cameras, using a high silver content emulsion, and a color negative light-sensitive material for cameras, these complex salts have disadvantages in that de-silvering is achieved only insufficiently, and a long period of time is needed for bleaching.

To accelerate the de-silvering process, West German Pat. No. 866,605 discloses a bleach-fixing solution containing a aminopolycarboxylic acid/iron (III) complex salt and a thiosulfuric acid salt. If, however, an aminopolycarboxylic acid/iron (III) complex salt having originally poor oxidizing power (bleaching power) is used in combination with the thiosulfuric acid salt having a reducing power, the bleaching power of the aminopolycarboxylic acid salt is seriously decreased. As a result, a light-sensitive material of high sensitivity and high silver content is quite difficult to de-silver sufficiently. Thus the above bleach-fixing solution is not totally satisfactory.

In order to increase the bleaching power of the aminopolycarboxylic acid/iron (III) complex salt, a method of adding various bleach-accelerating agents to a bleaching bath, or a bleach-fixing bath, or their prebaths has been proposed. Typical examples of such bleach-accelerating agents are mercapto compounds as described in U.S. Pat. No. 3,893,858, British Pat. No. 138,842, and Japanese Patent Application (OPI) No. 141623/78 (the term "OPI" as used herein means a "published unexamined Japanese patent application"), compounds containing a disulfide bond as described in Japanese Patent Application (OPI) No. 95630/78, thiazolidine derivatives as described in Japanese Patent Publication No. 9854/78, isothiourea derivatives as described in Japanese Patent Application (OPI) No. 94927/78, thiourea derivatives as described in Japanese Patent Publication Nos. 8506/70 and 26586/74, thioamide compounds as described in Japanese Patent Application (OPI) No. 42349/74, and dithiocarbamic acid salts as described in Japanese Patent Application (OPI) No. 26506/80.

Even by using a bleach-fixing solution with the above bleach-fixing agent added thereto, a sufficient bleaching effect is difficult to obtain, depending on the specific type of the light-sensitive material.

As described above, many problems are encountered in sufficiently bleaching a color-sensitized light-sensitive material. It is also known that in the case in which bleach-fixing is carried out continuously, when the amount of a component accumulated in the bleach-fixing solution, particularly iodide ion released from the light-sensitive material, exceeds a critical level, the bleaching speed is seriously decreased. The amount of the iodide ion accumulated in the bleach-fixing solution greatly depends on the halogen composition of a silver halide emulsion used in the light-sensitive material, or on a critical accumulation amount calculated from the amount of the bleach-fixing solution being replenished. It has now been specifically found that when the amount of the iodide ion exceeds $1.2\times10^{-3}$ gram ion per liter of the bleach-fixing solution, the bleaching speed is influenced.

It is known that a sensitizing dye adsorbed on silver halide is strongly adsorbed on developed silver during the developing process, thereby decreasing the bleaching speed. That is, Matsuo et al, *Nippon Shashin Gakkaishi* (*Journal of Japanese Photographic Association*), Vol. 39 (2), p. 81 (1976) describes that the physical properties of the sensitizing dye, particularly adsorption properties and the charged state, exert influences on the bleaching speed.

If, however, the amount of iodide ion accumulated in the bleach-fixing solution is greatly increased, the bleaching speed cannot be improved simply by taking into consideration only the physical properties of the sensitizing agent as described in the above Matsuo et al reference.

SUMMARY OF THE INVENTION

An object of the present invention is to provide a processing method whereby a satisfactorily high bleaching speed can be obtained even when a silver halide color photographic material is processed with a monobath bleach-fixing solution which is fatigued to such an extent that the amount of the iodide ion exceeds $1.2\times10^{-3}$ gram ion per liter of the bleach-fixing solution.

It has now been found that the above object can be attained by incorporating at least one sensitizing dye selected from the compounds represented by formulae (I) to (III) as described hereinafter into the silver halide color photographic material. That is, it has been found that incorporation of the sensitizing dyes represented by formulae (I) to (III) provides a light-sensitive material in which the bleaching speed is not unduly decreased even when it is processed with a bleach-fixing solution with a high level of iodide ions accumulated therein.

Astonishingly, it has also been found that the effect of the present invention can be sufficiently exhibited even if the amount of iodide ion in the bleach-fixing solution exceeds $2.4\times10^{-3}$ gram ion per liter of the bleach-fixing solution.

Accordingly the present invention relates to a process for processing a silver halide color photographic material which comprises developing an imagewise exposed light-sensitive material and then bleach-fixing it, wherein the bleach-fixing solution contains iodide ions in an amount exceeding $1.2\times10^{-3}$ gram ion/liter of the solution, and the light-sensitive material contains at least one sensitizing dye selected from the compounds represented by formulae (I) to (III).

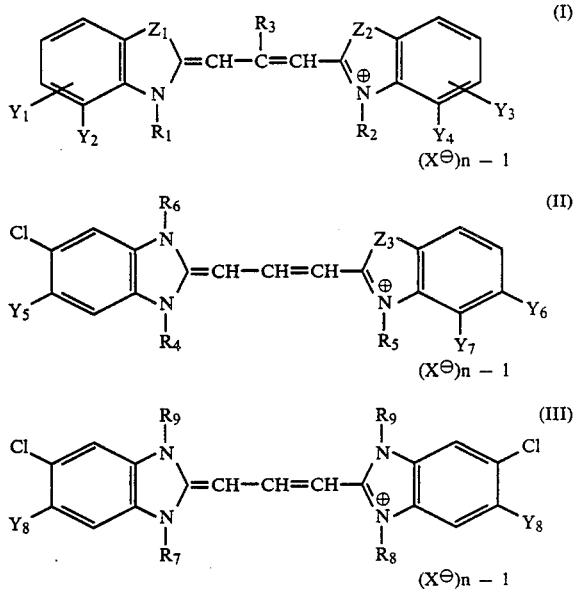

(I)

(II)

(III)

DETAILED DESCRIPTION OF THE INVENTION

As earlier indicated, the bleach-fixing solution contains iodide ions in an amount exceeding $1.2\times10^{-3}$ gram ion/liter of the solution.

The iodide ions should not exceed an amount where bleaching and fixing do not effectively proceed and the desilvering effect of the sensitizing dyes of the present invention does not effectively proceed or is inhibited. The upper limit on the iodide ions will be about 0.8 gram/liter as KI which corresponds to about $4.82\times10^{-3}$ gram ion/liter.

The formulae (I) to (III) are hereinafter explained in more detail.

In formula (I), $R_1$ and $R_2$ (which may be the same or different) each represents an unsubstituted alkyl group, preferably containing 8 or less carbon atoms (e.g., a methyl group, an ethyl group, a propyl group, an allyl group, a butyl group, a pentyl group, and a cyclohexyl group), or a substituted alkyl group in which the alkyl moiety preferably contains 6 or less carbon atoms, and more preferably 4 or less carbon atoms. Substituents of the substituted alkyl group include a carboxyl group, a sulfo group, a cyano group, a halogen atom (e.g., a fluorine atom, a chlorine atom, or a bromine atom), a hydroxyl group, an alkoxycarbonyl group containing 8 or less carbon atoms (e.g., a methoxycarbonyl group, an ethoxycarbonyl group, and a benzyloxycarbonyl group), an alkoxyl group containing 7 or less carbon atoms (e.g., a methoxy group, an ethoxy group, a propoxy group, a butoxy group, and a benzyloxy group), an aryloxy group (e.g., a phenoxy group and a p-tolyloxy group), an acyloxy group containing 3 or less carbon atoms (e.g., an acetyloxy group and a propionyloxy group), an acyl group containing 8 or less carbon atoms (e.g., an acetyl group, a propionyl group, a benzoyl group, and a mesyl group), a carbamoyl group (e.g., a carbamoyl group, an N,N-dimethylcarbamoyl group, a morpholinocarbamoyl group, and a piperidinocarbamoyl group), a sulfamoyl group (e.g., a sulfamoyl group, an N,N-dimethylsulfamoyl group, a morpholinosulfonyl group, and a piperidinosulfonyl group), and an aryl group (e.g., a phenyl group, a p-hydroxyphenyl group, a p-carboxyphenyl group, a p-sulfophenyl group, and an α-naphthyl group). The alkyl group may be substituted with two or more of the above substituents.

Prefeferably at least one of $R_1$ and $R_2$ represents a substituted alkyl group in which the substituent contains a sulfo group or a carboxyl group. More preferably $R_1$ and $R_2$ are both substituted alkyl groups containing a sulfo group or carboxyl group.

$R_3$ is an alkyl group containing from 1 to 3 carbon atoms (e.g., a methyl group, an ethyl group, and a butyl group) or a phenyl group.

$Z_1$ and $Z_2$ (which may be the same or different) each represents an oxygen atom, a sulfur atom, or a selenium atom.

$Y_1$ represents a phenyl group, or, when $Z_1$ represents a sulfur atom or a selenium atom, $Y_1$ represents a phenyl group or a chlorine atom.

$Y_3$ is a phenyl group, an alkyl group, an alkoxyl group, or a chlorine atom.

$Y_2$ and $Y_4$ each represents a hydrogen atom or $Y_1$ and $Y_2$ combine together to form a benzene ring or $Y_3$ and $Y_4$ combine together to form a benzene ring.

The number of carbon atoms contained in the alkyl or alkoxyl group represented by $Y_3$ is preferably 5 or less.

X is an acid anion.

n is 1 when the sensitizing dye of formula (I) forms an inner salt, or otherwise is 2.

In formula (II), $R_4$ and $R_5$ each represents an unsubstituted alkyl group or a substituted alkyl group as in the case of formula (I).

$R_6$ represents an alkyl group containing from 1 to 2 carbon atoms.

$Z_3$ represents an oxygen atom, a sulfur atom, or a selenium atom.

$Y_5$ represents an chlorine atom, a fluorine atom, or a cyano group.

$Y_6$ represents a phenyl group, and $Y_7$ represents a hydrogen atom, or $Y_6$ and $Y_7$ combine together to form a benzene ring.

X represents an acid anion.

n is 1 or 2.

In formula (III), $R_7$ and $R_8$ each represents an alkyl group or a substituted alkyl group as in the case of formula (I).

$R_9$ represents an alkyl group containing from 1 to 2 carbon atoms.

$Y_8$ represents a chlorine atom or a cyano group.

Typical examples of the sensitizing dyes represented by formulae (I) to (III) are shown below, although the present invention is not limited thereto.

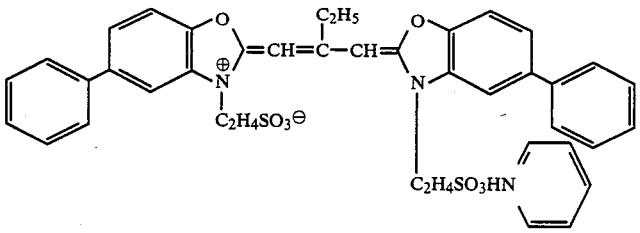
(1)

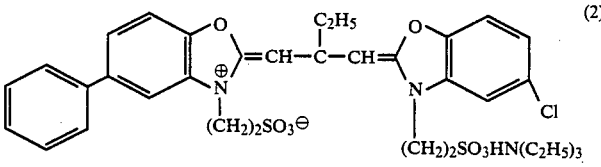
(2)

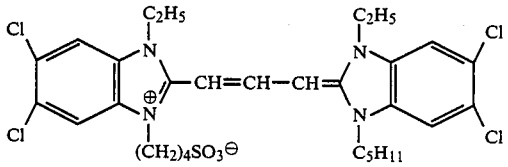
(3)

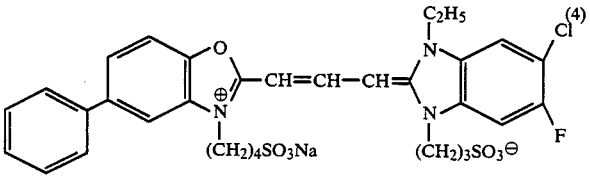
(4)

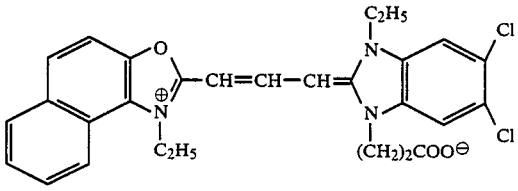
(5)

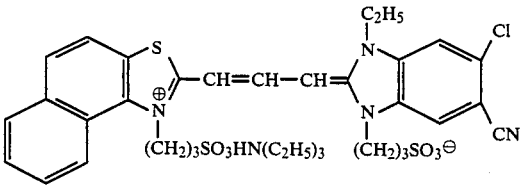
(6)

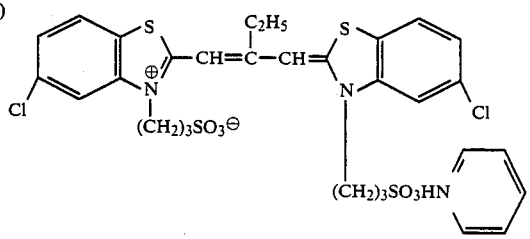
(7)

-continued (8)

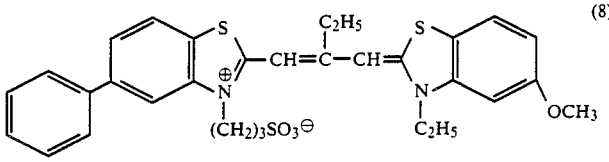

(9)

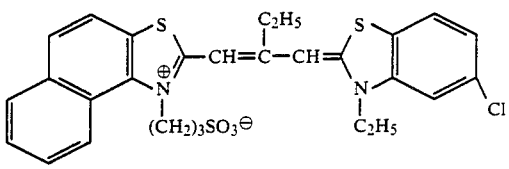

(10)

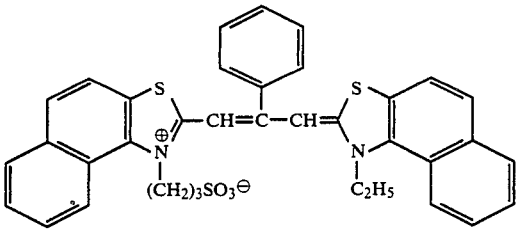

(11)

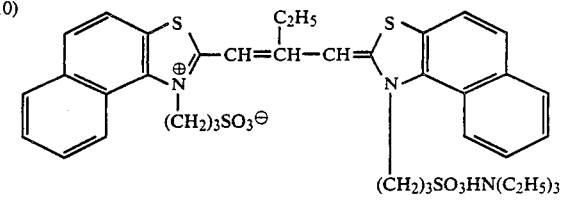

(12)

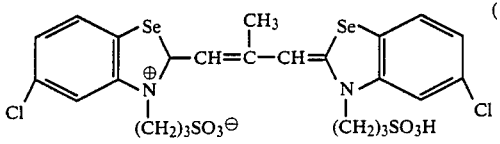

(13)

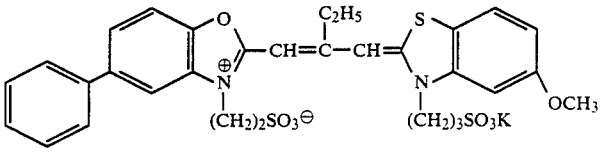

(14)

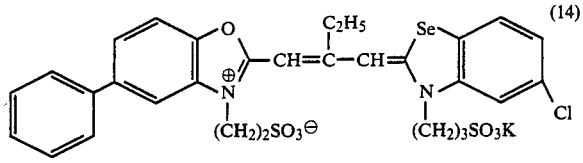

(15)

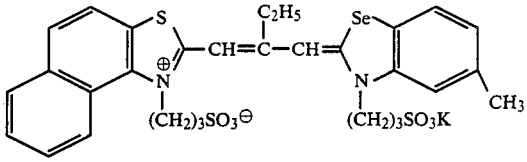

(16)

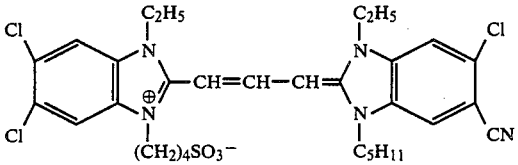

(17)

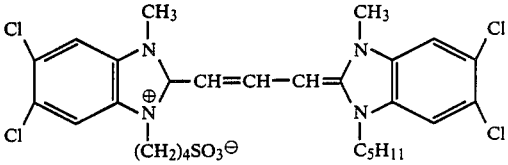

(18)

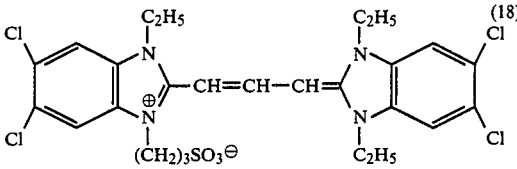

(19)

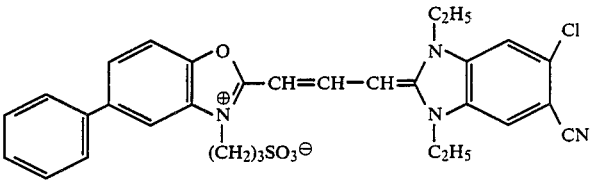

(20)

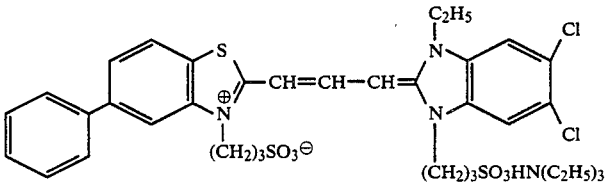

The sensitizing dyes of formulae (I) to (III) are known and can be easily prepared referring to the methods as described in Japanese Patent Publication Nos. 13823/68 (U.S. Pat. No. 3,793,020), 16589/69 (U.S. Pat. No. 3,615,638), 9966/73 (U.S. Pat. No. 3,656,959), and 4936/68, and Japanese Patent Application (OPI) No. 82416/77.

The sensitizing dye of the present invention is generally incorporated in the silver halide photographic emulsion in a proportion of from $1\times10^{-6}$ to $5\times10^{-3}$ mol, preferably from $1\times10^{-5}$ to $2.5\times10^{-3}$ mol, and especially preferably from $4\times10^{-5}$ to $1\times10^{-3}$ mol per mol of silver halide.

The sensitizing dye of the present invention can be dispersed directly in the emulsion. In accordance with another method, the sensitizing dye is first dissolved in a suitable solvent such as methyl alcohol, ethyl alcohol, methyl cellosolve, acetone, water, pyridine or their mixed solvents and then added to the emulsion in the form of a solution. Supersonic waves can be applied in the dissolving process. Other methods of adding the sensitizing dye which can be employed include a method as described in U.S. Pat. No. 3,469,987 in which the sensitizing dye is dissolved in a volatile organic solvent, the resulting solution is dispersed in hydrophilic colloid to form a dispersion, and the dispersion thus formed is added to the emulsion; a method as described in Japanese Patent Publication No. 24185/71 in which the water-insoluble dye is dispersed in a water-soluble solvent without dissolving in any solvent and the dispersion thus formed is added to the emulsion; a method as described in U.S. Pat. No. 3,822,135 in which the sensitizing dye is dissolved in a surface active agent and the solution thus formed is added to the emulsion; a method as described in Japanese Patent Application (OPI) No. 74624/78 in which the sensitizing dye is dissolved in a compound capable of red shifting and the solution thus formed is added to the emulsion; and a method as described in Japanese Patent Application (OPI) No. 80826/75 in which the sensitizing dye is dissolved in an acid not substantially containing water and the solution thus formed is added to the emulsion. In addition, the methods described in U.S. Pat. No. 2,912,343, 3,342,605, 2,996,287, and 3,429,835 can be used. The sensitizing dye may be uniformly dispersed in the silver halide emulsion prior to coating on a suitable support. Of course, the sensitizing dye can be dispersed at any stage of preparation of the silver halide emulsion.

In the case of a multi-layer color photographic material, the sensitizing dye of the present invention is added to a layer provided for improving the bleaching speed, and preferably to a red-sensitive emulsion layer and/or a green-sensitive emulsion layer.

The silver halide used in the present invention may be any of silver chloride, silver bromide, silver iodide, silver chlorobromide, silver chloroiodide, silver iodobromide, silver chloroiodobromide, and the like. Of these compounds, silver chlorobromide, and silver iodobromide and preferably used in the present invention.

The emulsion may be composed of coarse particles or finely divided particles, or a mixture thereof. These silver halide particles are formed by conventional techniques such as the single jet process, the double jet process, and the controlled double jet process.

The silver halide particles may have a crystal structure that is uniform throughout the interior thereof, or a layer-like crystal structure in which the core is different from the outer layer, or a so-called conversion type structure as described in British Pat. No. 635,841 and U.S. Pat. No. 3,622,318. Silver halide particles of the type wherein a latent image is formed mainly on the surface thereof, and of the type wherein the latent image is formed mainly in the interior thereof can be used. These photographic emulsions can be prepared by various techniques such as the ammonia process, the neutral process, and the acid process, which are well known in the art and described, for example, in Mees, *The Theory of Photographic Process,* 3rd Edition, Chapter 2, pp 31–44 (1987) MacMillan Corp., and Glafikides, *Photographic Chemistry,* Vol. 1, Chapter XVIII & XLX, pp 298–336 (1958) Fountain Press Co. After the formation of such silver halide particles, they are washed with water to remove by-product water soluble salts (e.g., potassium nitrate when silver bromide is prepared from silver nitrate and potassium bromide) and then heat treatment is applied in the presence of a chemical sensitizer to increase their sensitivity without increasing the size of the particles. This heat treatment can be applied without removal of the by-product water-soluble salts. The general method for this purpose is described in the above-cited Mees and Glafikides references.

The average particle diameter (as determined by the projected area method; number average diameter) of silver halide particles is preferably from about 0.04 to 4 μm.

In the formation of these silver halide particles, as silver halide solvents for controlling the growth of the particles, ammonia, potassium rhodanate ammonium rhodanate, thioether compounds (as described, for example, in U.S. Pat. Nos. 3,271,157, 3,574,628, 3,704,130, 4,297,439, and 4,276,374), thione compounds (as described, for example, in Japanese Patent Application (OPI) Nos. 144319/78, 82408/78, and 77737/80), amine compounds (as described, for example, in Japanese Patent Application (OPI) No. 100717/79), and the like can be used.

The silver halide photographic emulsion can be chemically sensitized by commonly used techniques such as gold sensitization (as described, for example, in U.S. Pat. No. 2,540,085, 2,597,876, 2,597,915, and 2,399,083), sensitization using Group VIII metal ions (as described, for example, in U.S. Pat. Nos. 2,448,060, 2,540,086, 2,556,245, 2,556,263, and 2,598,079), and sulfur sensitization (as described, for example, in U.S. Pat. Nos. 1,574,944, 2,278,947, 2,440,206, 2,410,689, 3,189,458, and 3,415,649), reduction sensitization (as described, for example, in U.S. Pat. Nos. 2,518,698, 2,419,974, and 2,983,610), sensitization using thioether compounds (as described, for example, in U.S. Pat. Nos. 2,521,929, 3,021,215, 3,038,805, 3,046,129, 3,046,132, 3,046,133, 3,046,134, 3,046,135, 3,057,724, 3,062,646, 3,165,552, 3,189,458, 3,192,046, 3,506,443, 3,671,260, 3,574,709, 3,625,697, 3,635,717, and 4,198,240), and their combinations.

Typical examples of chemical sensitizers which can be used are sulfur sensitizers such as allyl thiocarbamide, thiourea, sodium thiosulfate, and cystine; noble metal sensitizers such as potassium chloroaurate, aurous thiosulfate, and potassium chloropalladate; and reduction sensitizers such as tin chloride, phenylhydrazine, and reductone.

In addition, polyoxyethylene derivatives (as described in British Pat. No. 981,470, Japanese Patent Publication No. 6475/56, and U.S. Pat. No. 2,716,062), polyoxypropylene derivatives, derivatives containing a quaternary ammonium group, and the like can be used.

Various compounds can be added to the photographic emulsion of the present invention for the purposes of preventing a decrease in sensitivity and the formation of fog during the preparation, storage (prior to use), or processing of the light-sensitive material. A wide variety of compounds are known for these purposes, including heterocyclic compounds such as nitrobenzimidazole, ammonium chloroplatinate, 4-hydroxy-6-methyl-1,3,3a,7-tetraazaindene, 3-methylbenzothiazole, and 1-phenyl-5-mercaptotetrazole, mercury-containing compounds, mercapto compounds, and metal salts. Examples of compounds which can be used as described in K. Mees, *The Theory of the Photographic Process,* 3rd ed., pp. 344–349 (1966). In addition, thiazolium salts as described in U.S. Pat. Nos. 2,131,038 and 2,694,716; azaindenes as described in U.S. Pat. Nos. 2,886,437 and 2,444,605; urazoles as described in U.S. Pat. No. 3,287,135; sulfocathechols as described in U.S. Pat. No. 3,236,652; oximes as described in British Pat. No. 623,448; mercaptotetrazoles as described in U.S. Pat. Nos. 2,403,927, 3,266,897, and 3,397,987; nitron;

nitroindazoles; polyvalent metal salts as described in U.S. Pat. No. 2,839,405; thiuronium salts as described in U.S. Pat. No. 3,220,839; the salts of palladium, platinum and gold as described in U.S. Pat. Nos. 2,566,263 and 2,587,915; and the like can be used.

Developing agents can be incorporated in the silver halide photographic emulsion such as hydroquinones, catechols, aminophenols, 3-pyrazolidones, ascorbic acid and its derivatives, reductones, phenylenediamines, and combinations thereof. The developing agent can be added to the silver halide emulsion layer and/or other photographic layers (e.g., a protective layer, an intermediate layer, a filter layer, an antihalation layer, and a back layer). The developing agent can be dissolved in a suitable solvent and added in the form of solution, or can be added in a dispersion form as described in U.S. Pat. No. 2,592,368 and French Pat. No. 1,505,778.

The emulsion can be hardened by the usual methods. Hardening agents which can be used include aldehyde compounds such as formaldehyde and glutaraldehyde; ketone compounds such as diacetyl and cyclopentanediones; reactive halogen-containing compounds such as bis-(2-chloroethylurea), 2-hydroxy-4,6-dichloro-1,3,5-triazine, and compounds as described in U.S. Pat. No. 3,288,775, 2,732,303, British Pat. Nos. 964,723, and 1,167,207; reactive olefin-containing compounds such as divinyl sulfone, 5-acetyl-1,3-diacryloylhexahydro-1,3,5-triazine, and compounds as described in U.S. Pat. Nos. 3,635,718, 3,232,763, and British Pat. No. 994,869; N-methylol compounds such as N-hydroxymethylphthalimide, and compounds as described in U.S. Pat. Nos. 2,732,316, and 2,586,168; isocyanates as described in U.S. Pat. No. 3,103,437; aziridine compounds as described in U.S. Pat. Nos. 3,017,280 and 2,983,611; acid derivatives as described in U.S. Pat. Nos. 2,725,294 and 2,725,295; carbodiimide compounds as described in U.S. Pat. No. 3,100,704; epoxy compounds as described in U.S. Pat. No. 3,091,537; isooxazole compounds as described in U.S. Pat. Nos. 3,321,313 and 3,543,292; halogenocarboxyaldehydes such as mucochloric acid; and dioxane derivatives such as dihydroxydioxane and dichlorodioxane.

As inorganic hardening agents, chromium alum, zirconium sulfate, and the like can be used.

Precursors of the above compounds can also be used. Examples of such precursors are alkali metal bisulfide/formaldehyde adducts, methylol derivatives of hydantoin, and primary aliphatic nitroalcohols.

Surface active agents can be added alone or in combination with each other to the photographic emulsion of the present invention. These surface active agents are used as coating aids and in some cases for other purposes, for example, for emulsification and dispersion, sensitization, improvement of photographic characteristics, prevention of electrification, or prevention of adhesion. They include natural surface active agents such as saponin, nonionic surface active agents such as alkylene oxide-, glycerine-, and glycidol-based compounds, cationic surface active agents such as higher alkylamines, quaternary ammonium salts, heterocyclic rings (e.g., pyridine), and phosphonium or sulfoniums, anionic surface active agents containing an acid group such as a carboxyl group, a sulfonyl group, a phosphonyl group, a sulfuric acid ester group, and a phosphoric acid ester group, and amphoteric surface active agents such as amino acids, aminosulfonic acids, and sulfonic acid or phosphoric acid esters of amino alcohols.

To the silver halide photographic emulsion of the present invention there can be added, as protective colloids, in addition to gelatin, acylated gelatins such as phthalated gelatin and malonated gelatin, cellulose compounds such as hydroxyethyl cellulose and carboxymethyl cellulose, soluble starch such as dextrin, hydrophilic polymers such as polyvinyl alcohol, polyvinyl pyrrolidone, polyacrylamide, and polystyrenesulfonic acid, and the like. Moreover, plasticizers for dimensional stabilization, latex polymers, and matting agents can be added to the emulsion.

The silver halide photographic emulsion may contain an antistatic agent, a plasticizer, a brightening agent, a development accelerator, an anti-air foggant, a color-controlling agent, and the like. In more detail, the compounds described in *Research Disclosure,* Vol. 176, RD No. 17643 (December 1978) can be used.

The silver halide photographic emulsion of the present invention can contain color couplers such as a cyan coupler, a magenta coupler, and a yellow coupler, and compounds to disperse therein the above couplers.

That is, the silver halide photographic emulsion may contain compounds capable of forming color through oxidative coupling with aromatic primary amine developers (e.g., phenylenediamine derivatives and aminophenol derivatives) during the color developing process. The magenta coupler, for example, includes a 5-pyrazolone coupler, a pyrazolobenzimidazole coupler, and cycloacetylcumarone coupler, and an open-chain acylacetonitrile coupler. The yellow coupler includes an acylacetamide coupler (e.g., benzoylacetoanilides and pivaloylacetoanilides). The cyan coupler includes a naphthol coupler and a phenol coupler. Non-diffusing couplers having a hydrophobic group referred to a "ballast group" are desirable. These couplers may be 4-equivalent or 2-equivalent in relation to silver ion. Colored couplers having a color correction effect, or couplers releasing a development inhibitor with the advance of development (so-called DIR (development inhibitor releasing) couplers) can be used.

In addition to the DIR couplers, colorless DIR coupling compounds producing a colorless coupling reaction product and releasing a development inhibitor can be used.

Of the color couplers, the 4-equivalent or 2-equivalent magenta couplers are preferably used. More preferably, a 2-equivalent magenta coupler is used. As the cyan coupler, it is preferred to use a cyan coupler containing a ureido group having improved anti-fading properties of the dye in that the dye image has good light and heat fastnesses.

Examples are described in U.S. Pat. Nos. 3,446,622, 3,996,253, 3,758,308, 3,880,661, Japanese Patent Application (OPI) No. 65134/81, Japanese Patent Application Nos. 196676/81, 1620/82, and 72202/82.

In addition to the DIR couplers, compounds releasing a development inhibitor with the advance of development may be incorporated in the light-sensitive material. For example, the compounds described in U.S. Pat. Nos. 3,297,445, 3,379,529, West German Patent Application (OLS) No. 2,417,914, Japanese Patent Application (OPI) Nos. 15271/77 and 9116/78 can be used.

In order to satisfy the characteristics required for the light-sensitive material, two or more of the couplers may be added to the same layer, or the same compound may be added to two or more layers.

The above couplers include couplers containing a water-soluble group, such as a carboxyl group, a hydroxyl group, and a sulfo group, and hydrophobic couplers. They are incorporated in the emulsion by conventionally known addition or dispersion methods.

In the case of the hydrophobic couplers, a method as described, for example, in U.S. Pat. Nos. 2,304,939 and 2,322,027 in which the coupler is mixed with high boiling organic solvents such as phthalic acid esters, trimellitic acid esters, phosphoric acid esters, fatty oils which are liquid at ordinary temperature, and waxes and then dispersed by the aid of anionic surface active agents; a method as described, for example, in U.S. Pat. Nos. 2,801,170, 2,801,171 and 2,949,360, in which the coupler is mixed with low boiling organic solvents or water-soluble organic solvents and then dispersed; and a method as described in, for example, West German Pat. No. 1,143,707 in which when the melting point of the coupler itself is sufficiently low (preferably less than 75° C.), it is dispersed alone or in combination with other couplers such as the colored coupler and the DIR coupler can be applied.

The water-soluble coupler can be added as an alkaline solution or as a dispersion aid for the hydrophobic coupler (i.e., one of anionic surface active agents) in combination with the hydrophobic coupler.

The color image can be formed by developing with a color developer containing a diffusing coupler.

As dyes for prevention or irradiation, which are added depending on the purpose, the compounds described, for example, in Japanese Patent Publication Nos. 20389/66, 3504/68, 13168/68, U.S. Pat. Nos. 2,697,037, 3,423,207, 2,865,752, British Pat. Nos. 1,030,392, and 1,100,546 can be used.

The color photographic light-sensitive material of the present invention includes a color negative film, a color reversal film, a color paper, a color reversal paper, a color positive film for movies, etc., and a light-sensitive material comprising a black dye image.

The light-sensitive material of the present invention is exposed to light by the usual method to obtain photographic images. That is, a wide variety of known litght sources such as natural light (sun light), a tungsten lamp, a fluorescent lamp, a mercury lamp, a xenon arc lamp, a carbon arc lamp, a xenon flash lamp, and a cathode ray tube flying spot can be used for this purpose. The exposure time may be from 1/1,000 to 1 second, which is usually used in cameras. Exposure for shorter than 1/1,000 second, such as for $1/10^4$ to $1/10^6$ second when a xenon flash lamp or a cathode ray tube is used can be applied. Also, exposure for longer than 1 second can be applied. If desired, the spectral composition of light can be controlled using a color filter. Exposure can be applied using laser light. Moreover, light emitted from a fluorescent substance excited by electron rays, X-rays, $\gamma$-rays, $\alpha$-rays, etc., can be applied.

The layer structure of a multi-layer color light-sensitive material which can be used in the present invention is not critical. A blue-sensitive layer (B), a green-sensitive layer (G), and a red-sensitive layer (R) can be coated on a support in various sequences. For example, the layers may be coated in the order (B), (G), and (R), in the order (R), (G), and (B), or in the order (B), (R), and (G). In the case that the layers are coated in the order (R), (G), and (B), it is desirable to interpose a yellow filter between layer (G) and layer (B).

The silver halide photographic emulsion is coated on the support, if necessary, along with other photographic layers. This coating can be performed by known techniques such as dip coating, air knife coating, curtain coating, and extrusion coating, using e.g., a hopper as described in U.S. Pat. No. 2,681,294.

The finished emulsion is coated on a suitable support.

The term "support" is used herein to mean a plate-shaped material which is not subject to serious dimensional changes during the processing. Depending on the purpose, a hard support like glass or a flexible support can be used. Typical examples of flexible supports are those commonly used in preparation of typical photographic light-sensitive materials, and include a cellulose nitrate film, a cellulose acetate film, a cellulose acetate butyrate film, a cellulose acetate propionate film, a polystyrene film, a polyethylene terephthalate film, a polycarbonate film, or laminates thereof, a thin glass film, and paper. In addition, supports such as paper coated or laminated with baryta or $\alpha$-olefin polymers, particularly polymers of $\alpha$-olefins containing from 2 to 10 carbon atoms, such as polyethylene, polypropylene, and an ethylene/butene copolymer, and a plastic film as described in Japanese Patent Publication No. 19068/72 in which the surface of the film is coarsened to improve its adhesion to other polymeric substances and also its printing suitability can be used with good results.

The opaque support includes, as well as paper which is originally opaque, a support comprising a transparent film with dyes or pigments such as titanium oxide incorporated therein, a plastic film the surface of which is treated by the method as described in Japanese Patent Publication No. 19068/72, and paper or plastic films which are made to entirely stop the passage of light therethrough by adding carbon black, dyes, or the like. When the adhesion force between the support and the photographic emulsion layer is not sufficiently high, a subbing layer is provided, as a layer exhibiting adhesion to both of the layers. In order to more improve adhesion properties, the surface of the support may be subjected to preliminary treatments such as corona discharge, irradiation with ultraviolet rays, and flame treatment.

Photographic processing of the light-sensitive material of the present invention can be carried out by known techniques. Known processing solutions can be used. The processing temperature is usually chosen within the range of 18° to 50° C. Lower temperatures than 18° C. and higher temperatures than 50° C. can be used. The process of the present invention can be applied to color photographic processing comprising a treatment of form a silver image (black-and-white photographic processing) and the subsequent treatment to form a dye image.

A developer for use in the black-and-white photographic processing can contain known developing agents. For example, dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, and heterocyclic compounds resulting from condensation of a 1,2,3,4-tetrahydroquinoline ring and an indolene ring as described in U.S. Pat. No. 4,067,872 can be used singly or in combination with each other. The developer may generally contain known additives such as a preservative, an alkali agent, a pH buffer, and an antifoggant, and, if desired, a dissolving aid, a color controller, a development accelerator, a surface active agent, a defoaming agent, a hard water-softening agent, a hardening agent, a tackifier, and the like.

The dye image can be formed by a conventional method. Examples include the negative/positive method (as described, for example, in *Journal of the*

*Society of Motion Picture and Television Engineers,* Vol. 61 (1953), pp. 667–701), the color reversal method in which a negative silver image is formed by developing with a developer containing a black-and-white developing agent, and is then subjected at least once to uniform exposure or another suitable fogging treatment, and, thereafter, color development is applied; and the silver/dye bleaching method in which a photographic emulsion layer containing a dye is first exposed and then developed to form a silver image and, thereafter, the dye is bleached with the silver image acting as a bleaching catalyst.

The light-sensitive material of the present invention can be color developed using aromatic primary amine compounds such as p-phenylenediamine derivatives. Typical examples of the color developing agents are the inorganic acid salts of N,N-diethyl-p-phenylenediamine, 2-amino-5-diethylaminotoluene, 2-amino-5-(N-ethyl-N-laurylamino)toluene, 4-[N-ethyl-N-(β-hydroxyethylamino]aniline, and 3-methyl-4-amino-N-ethyl-N-(β-hydroxyethyl)aniline, 4-amino-3-methyl-N-ethyl-N-(β-methanesulfamidoethyl)aniline sesquesulfate monohydrate as described in U.S. Pat. No. 2,193,015, N-(2-amino-5-diethylaminophenylethyl)methanesulfonamide sulfuric acid salts as described in U.S. Pat. No. 2,592,364, and 3-methyl-4-amino-N-ethyl-N-methoxyethylaniline as described in Japanese Patent Application (OPI) No. 64933/73.

Details of these color developing agents are described, for example, in L. G. A. Mason, *Photographic Processing Chemistry,* Focal Press, London (1966), pp. 226–229. The color developing agents can be used in combination with 3-pyrazolidones.

If desired, various additives can be added to the color developer.

Typical examples of such additives are alkali agents (e.g., alkali metals, ammonium hydroxides, carbonates, and phosphates), pH-adjusting agents or buffers (e.g., weak acids and weak bases, such as acetic acid and boric acid, and their salts), development accelerators (e.g., various pyridinium compounds as described in U.S. Pat. Nos. 2,648,604 and 3,671,247, cationic compounds, potassium nitrate, sodium nitrate, polyethylene glycol condensates and their derivatives as described in U.S. Pat. Nos. 2,533,990, 2,577,127, and 2,950,970, nonionic compounds such as polyethioethers exemplified by compounds as described in British Pat. Nos. 1,020,033 and 1,020,032, polymers containing a sulfite ester group as exemplified by the compounds described in U.S. Pat. No. 3,068,097, pyridine, ethanolamine, organic amines, benzyl alcohol, and hydrazines), antifoggants (e.g., alkali bromide, alkali iodide, nitrobenzimidazoles as described in U.S. Pat. Nos. 2,496,940 and 2,656,271, mercaptobenzimidazole, 5-methylbenztriazole, 1-phenyl-5-mercaptotetrazole, compounds for a rapid processing solution as described, for example, in U.S. Pat. Nos. 3,113,864, 3,342,596, 3,295,976, 3,615,522, 3,597,199, thiosulfonyl compounds as described in British Pat. No. 972,211, phenazine-N-oxides as described in Japanese Patent Publication No. 41675/71, and antifoggants as described in *Kagaku Shashin Binran* (Handbook of Scientific Photograph), Vol. 2, pp 29–47), stain or sludge-preventing agents as described in U.S. Pat. Nos. 3,161,513 and 3,161,514, British Pat. Nos. 1,030,442, 1,144,481, and 1,251,558, multilayer effect accelerating agents as described in U.S. Pat. No. 3,536,487, and preservatives (e.g., sulfurous acid salts, acidic sulfurous acid salts, hydroxylamine hydrochloric acid salts, sodium formaldehyde bisulfide, and alkanolamine sulfite adducts).

The silver halide photographic emulsion is bleached and fixed by a conventional method after development. It is only when the bleaching and fixation are carried out at the same time that the object of the present invention can be attained sufficiently. In order to carry out the bleaching and fixation at the same time, it is sufficient to prepare a bleach-fixing bath by adding the bleaching and fixing agents. Many compounds can be used as bleaching agents. In general, ferricyanic acid salts, dichromic acid salts, water-solution cobalt (III) salts, water-soluble copper (II) salts, water-soluble quinones, nitrsophenol, polyvalent metal (e.g., iron (III), cobalt (III), and copper (II)) compounds, particularly complex salts of these polyvalent metal cations and organic acids, such as metal complex salts of aminopolycarboxylic acids such as ethylenediaminetetraacetic acid, nitrilotriacetic acid, iminodiacetic acid, and N-hydroxyethylethylenediaminetriacetic acid, malonic acid, tartaric acid, malic acid, diglycolic acid, and dithioglycolic acid, 2,6-dipicolic acid/copper complex salts, peracids such as alkanoic peracid, persulfuric acid, permanganic acid, and hydrogen peroxide, and hypochlorous acid salts such as those of chlorine and bromine, and a bleaching powder can be used, singly or in combination with each other.

As fixing agents, in addition to thiosulfuric acid salts and thiocyanic acid salts, organosulfur compounds known to have a fixing effect can be used.

To the processing solution can be added various additives such as bleach-accelerating agents as described in U.S. Pat. Nos. 3,042,520, 3,241,966, Japanese Patent Publication Nos. 8506/70 and 8836/70.

As can be easily understood, if the processing is carried out continuously, substances contained in the light-sensitive material accumulate in the processing solution.

In accordance with the present invention, even in cases where the amount of iodide ions accumulated in the bleach-fixing bath exceeds $1.2\times10^{-3}$ gram ion/l, the light-sensitive material can be processed at a sufficiently high bleaching speed. Furthermore, the light-sensitive material of the present invention can be processed efficiently with a bleach-fixing solution in which the amount of iodide ions accumulated exceeds $2.4\times10^{-3}$ gram ion/l.

The present invention is described in greater detail with reference to the following examples, although it is not limited thereto.

EXAMPLE 1

A paper support with polyethylene laminated on both sides thereof was coated with the first layer (lowermost layer) to 11th layer as shown in Table 1 to produce a color photographic light-sensitive material.

TABLE 1

| | Amount |
|---|---|
| Eleventh Layer (Protective Layer) | |
| Gelatin | 1,000 mg/m$^2$ |
| Silver chlorobromide emulsion (silver bromide: 2.0 mol %: size: 0.2 μm) | 10 mg/m$^2$ (calculated as silver) |
| Tenth Layer (Ultraviolet Ray-Absorbing Layer) | |
| Gelatin | 1,500 mg/m$^2$ |
| Ultraviolet ray-absorbing agent (*1) | 1,000 mg/m$^2$ |
| Solvent for the above agent (*2) | 300 mg/m$^2$ |
| Color mixing-preventing agent (*3) | 80 mg/m$^2$ |

TABLE 1-continued

| | Amount |
|---|---|
| **Nineth Layer (High Sensitivity Blue-Sensitive Layer)** | |
| Silver iodobromide emulsion (silver iodide: 2.5 mol %: average size: 1.0 μm) | 200 mg/m$^2$ (calculated as silver) |
| Blue-sensitizing dye (*4) | |
| Gelatin | 1,000 mg/m$^2$ |
| Yellow coupler (*5) | 400 mg/m$^2$ |
| Solvent for the above coupler (*2) | 100 mg/m$^2$ |
| **Eighth Layer (Low Sensitivity Blue-Sensitive Layer)** | |
| Silver iodobromide emulsion (silver iodide: 2.5 mol %; average size: 0.5 μm) | 150 mg/m$^2$ (calculated as silver) |
| Blue sensitizing dye (*4) | |
| Gelatin | 500 mg/m$^2$ |
| Yellow coupler (*5) | 200 mg/m$^2$ |
| Solvent for the above coupler (*2) | 50 mg/m$^2$ |
| **Seventh Layer (Yellow Filter Layer)** | |
| Yellow colloid silver | 200 mg/m$^2$ |
| Gelatin | 1,000 mg/m$^2$ |
| Color mixing-preventing agent (*6) | 60 mg/m$^2$ |
| Solvent for the above agent (*7) | 240 mg/m$^2$ |
| **Sixth Layer (High Sensitivity Green-Sensitive Layer)** | |
| Silver iodobromide emulsion (silver iodide: 3.5 mol %; average size: 0.9 μm) | 200 mg/m$^2$ (calculated as silver) |
| Green sensitizing dye | |
| Gelatin | 700 mg/m$^2$ |
| Magenta coupler (*9) | 150 mg/m$^2$ |
| Antifading agent A (*10) | 50 mg/m$^2$ |
| Antifading agent B (*11) | 50 mg/m$^2$ |
| Antifading agent C (*12) | 20 mg/m$^2$ |
| Solvent for the above coupler (*13) | 150 mg/m$^2$ |
| **Fifth Layer (Low Sensitivity Green-Sensitive Layer)** | |
| Silver iodobromide emulsion (silver iodide: 2.5 mol %; average size: 0.4 μm) | 200 mg/m$^2$ (calculated as silver) |
| Same green sensitizing dye, gelatin magenta coupler, antifading agent, and solvent for the coupler as used in the 6th layer | |
| **Fourth Layer (Intermediate Sensitivity Layer)** | |
| Yellow colloidal silver | 20 mg/m$^2$ |
| Gelatin | 1,000 mg/m$^2$ |
| Color mixing-preventing agent (*6) | 80 mg/m$^2$ |
| Solvent for the above agent (*7) | 160 mg/m$^2$ |
| Polymer latex (*14) | 400 mg/m$^2$ |
| **Third Layer (High Sensitivity Red-Sensitive Layer)** | |
| Silver iodobromide emulsion (silver iodide: 8.0 mol %; average size: 0.7 μm) | 100 mg/m$^2$ (calculated as silver |
| Red sensitizing dye | |
| Gelatin | 500 mg/m$^2$ |
| Cyan coupler (*17) | 100 mg/m$^2$ |
| Antifading agent (*18) | 50 mg/m$^2$ |
| Solvent for the coupler (*5, 19) | 20 mg/m$^2$ |
| **Second Layer (Low Sensitivity Red-Sensitive Layer)** | |
| Silver iodobromide emulsion (silver iodide: 3.5 mol %; average size: 0.35 μm) | 150 mg/m$^2$ (calculated as silver) |
| Red sensitizing dye | |
| Gelatin | 1,000 mg/m$^2$ |
| Cyan coupler (*17) | 300 mg/m$^2$ |
| Antifading agent (*18) | 150 mg/m$^2$ |
| Solvent for the above coupler (*5, 19) | 60 mg/m$^2$ |
| **First Layer (Antihalation Layer)** | |
| Black colloid silver | 100 mg/m$^2$ |
| Gelatin | 2,000 mg/m$^2$ |
| **Support** | |
| Polyethylene-laminated paper (the polyethylene layer in contact with the first layer contained white pigment (e.g., $TiO_2$) and bluish dye (e.g., ultramarine).) | |

TABLE 1-continued

The components of the above-described material are identified as follows:
(*1) 5-Chloro-2-(2-hydroxy-3-tert-butyl-5-octyl)
(*2) Trinonyl phosphate
(*3) 2,4-di-sec-Octylhydroquinone
(*4) Triethylammonium 3-[2-(3-benzylrhodanine-5-ylidene)-3-benzoxazolinyl]propane sulfonate
(*5) α-Pivaloyl-α-[2,4-dioxy-1-benzyl-5-ethoxyhydantoin-3-yl)-2-chloro-5-[α-2,4,-di-tert-amylphenoxy)-butaneamido]acetoanilide
(*6) 2,4-di-tert-Octylhydroquinone
(*7) o-Cresyl phosphate
(*9) 1-(2,4,6-Trichlorophenyl)-3-[2-chloro-5-tetrade-caneamido]anilino-2-pyrazolidno-5-one
(*10) 3,3,3',3'-Tetramethyl-5,6,5'6'-tetrapropoxy-1,1'-bisspiroindane
(*11) Di-[2-hydroxy-3-ter-butyl-5-methylphenyl]methane
(*12) 2,4-Di-tert-hexylhydroquinone
(*13) Trioctyl phosphate
(*14) Polyethyl acrylate
(*17) 2-[α-(2,4-Di-tert-amylphenoxy)butaneamido]-4,6-di-chloro-5-methylphenol
(*18) 2-(2-Hydroxy-3-sec-butyl-5-tert-butylphenyl)-benzotriazole
(*19) Dioctyl phthalate In the second and third layers, and sixth and seventh layers of the light-sensitive film, sensitizing dyes as shown in Table 2 were added to produce light-sensitive materials (Samples 1—1 to 1-4). Half of each film sample was exposed to light for 0.5 second at an illumination of 1,000 lux by the use of a light source having a color temperature of 3,200° K. After exposure, the sample was developed in the manner as described below. Then the amount of silver remaining in exposed and unexposed areas were determined by the use of a silver amount-analyzing apparatus using fluorescent X-rays. The same experiment as above was carried out using a bleach-fixing solution with 0.2 g/l or 0.4 g/l of KI added thereto.

The results are shown in Table 3.

| Processing Steps | Temperature (°C.) | Time (seconds) |
|---|---|---|
| First development (black-and-white development) | 38 | 75 |
| Washing with water | 38 | 90 |
| Reversal exposure (100 lux) | | |
| Color development | 38 | 135 |
| Washing with water | 38 | 45 |
| Bleach-fixing | 38 | 120 |
| Washing with water | 38 | 135 |
| Drying | | |

| Composition of Processing Solution | |
|---|---|
| **First Developer** | |
| Hexasodium nitrilo-N,N,N—trimethylene phosphate | 3.0 g |
| Anhydrous potassium sulfite | 20.0 g |
| Sodium thiocyanate | 1.2 g |
| 1-Phenyl-4-methyl-4-hydroxymethyl-3-pyrazolidone | 2.0 g |
| Anhydrous sodium carbonate | 30.0 g |
| Potassium hydroquinone monosulfonate | 30.0 g |
| Potassium bromide | 2.5 g |
| Potassium iodide (0.1% aqueous solution) | 2 ml |
| Water to make | 1,000 ml |
| The pH was adjusted to 9.7. | |
| **Color Developer** | |
| Benzyl alcohol | 15.0 ml |
| Ethylene glycol | 12.0 ml |
| Hexasodium nitrilo-N,N,N—trimethylene phosphate | 3.0 g |
| Potassium carbonate | 26.0 g |
| Sodium sulfite | 2.0 g |
| 1,2-Di(2'-hydroxyethyl)mercaptoethane | 0.6 g |
| Hydroxylamine sulfate | 3.0 g |
| 3-Methyl-4-amino-N—ethyl-N—β-methane-sulfonamidoethylaniline sulfate | 5.0 g |
| Sodium bromide | 0.5 g |

-continued

| Processing Steps | Temperature (°C.) | Time (seconds) |
|---|---|---|
| Potassium iodide (0.1% aqueous solution) | | 0.5 ml |
| Water to make | | 1,000 ml |
| The pH was adjusted to 10.5. | | |
| Bleach-Fixing Solution | | |
| Iron (III) ammonium ethylenediamine-N,N,N'N'-tetraacetate (dihydrate) | | 80.0 g |
| Sodium metahydrogensulfite | | 15.0 g |
| Ammonium metasulfate (58% aqueous solution) | | 126.6 ml |
| 2-Mercapto-1,3,5-triazole | | 0.20 g |
| The pH was adjusted to 6.5. | | |

-continued

| | |
|---|---|
| Gelatin layer containing black colloid silver | |
| Second Layer (Intermediate Layer) | |
| Gelatin layer containing a dispersion of 2,5-di-tert-octylhydroquinone | |
| Third Layer (First Red-Sensitive Emulsion Layer) | |
| Silver iodobromide emulsion (silver iodide: 5 mol %) | 1.6 g/m$^2$ (calculated as silver) |
| Red sensitizing dye (see Table 4) | |
| Coupler EX-1 | 0.04 mol per mol of silver |
| Coupler EX-3 | 0.003 mol per mol of silver |
| Coupler EX-9 | 0.0006 mol per mol of silver |
| Fourth Layer (Second Red-Sensitive Emulsion Layer) | |
| Silver iodobromide emulsion (silver iodide: 10 mol %) | 1.4 g/m$^2$ (calculated as silver) |
| Red sensitizing dye (see Table 4) | |
| Coupler EX-1 | 0.002 mol per mol of silver |
| Coupler EX-2 | 0.02 mol per mol of silver |
| Coupler EX-3 | 0.0016 mol per mol of silver |
| Fifth Layer (Intermediate Layer) | |
| Same as the second layer. | |
| Sixth Layer (First Green-Sensitive Emulsion Layer) | |
| Silver iodobromide emulsion | 1.2 g/m$^2$ |

TABLE 2

| | Second Layer | Third Layer | Sixth Layer | Seventh Layer |
|---|---|---|---|---|
| Sample 1-1 | Dye (11) of the invention 0.20 mg/m$^2$ | Dye (11) of the invention 0.15 mg/m$^2$ | Dye (1) of the invention 0.15 mg/m$^2$ | Dye (1) of the invention 0.10 mg/m$^2$ |
| Sample 1-2 | Dye (11) of the invention 0.20 mg/m$^2$ | Dye (11) of the invention 0.15 mg/m$^2$ | Green sensitizing dye A 0.15 mg/m$^2$ | Green sensitizing dye A 0.10 mg/m$^2$ |
| Sample 1-3 | Red sensitizing dye A 0.20 mg/m$^2$ | Red sensitizing dye A 0.15 mg/m$^2$ | Dye (1) of the invention 0.15 mg/m$^2$ | Dye (1) of the invention 0.10 mg/m$^2$ |
| Sample 1-4 | Red sensitizing dye A 0.20 mg/m$^2$ | Red sensitizing dye A 0.15 mg/m$^2$ | Green sensitizing dye A 0.15 mg/m$^2$ | Green sensitizing dye A 0.10 mg/m$^2$ |

Red sensitizing dye A:

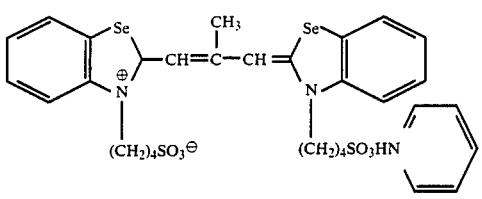

Green sensitizing dye A:

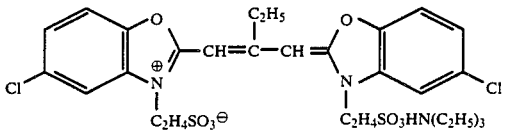

TABLE 3

| | Amount of Residual Silver (μg/cm$^2$) | | | | | |
|---|---|---|---|---|---|---|
| | A | | B | | C | |
| Sample | Unexposed Area | Exposed Area | Unexposed Area | Exposed Area | Unexposed Area | Exposed Area |
| 1-1 | less than 0.1 | less than 0.1 | 0.2 | 0.2 | 0.4 | 0.4 |
| 1-2 | less than 0.1 | less than 0.1 | 0.5 | 0.4 | 0.6 | 0.6 |
| 1-3 | less than 0.1 | less than 0.1 | 0.3 | 0.3 | 0.6 | 0.5 |
| 1-4 (Comparative Example) | less than 0.1 | less than 0.1 | 1.0 | 0.9 | 2.2 | 2.0 |

Note:
A: The bleach-fixing solution did not contain KI.
B: The bleach-fixing solution contained 0.2 g/l of KI.
C: The bleach-fixing solution contained 0.4 g/l of KI.

It can be seen from the results shown in Table 3 that in the light-sensitive samples containing the dyes of the present invention, the bleaching speed is excellent even when the material is processed with a bleach-fixing solution containing iodide ions.

EXAMPLE 2

The following layers are provided on a triacetyl cellulose film support to produce a multi-layer color light-sensitive material.

| | |
|---|---|
| First Layer (Antihalation Layer) | |
| Gelatin layer containing black colloid silver | |
| Second Layer (Intermediate Layer) | |
| Gelatin layer containing a dispersion of 2,5-di-tert-octylhydroquinone | |
| Third Layer (First Red-Sensitive Emulsion Layer) | |
| Silver iodobromide emulsion (silver iodide: 5 mol %) | 1.6 g/m$^2$ (calculated as silver) |
| Red sensitizing dye (see Table 4) | |
| Coupler EX-1 | 0.04 mol per mol of silver |
| Coupler EX-3 | 0.003 mol per mol of silver |
| Coupler EX-9 | 0.0006 mol per mol of silver |
| Fourth Layer (Second Red-Sensitive Emulsion Layer) | |
| Silver iodobromide emulsion (silver iodide: 10 mol %) | 1.4 g/m$^2$ (calculated as silver) |
| Red sensitizing dye (see Table 4) | |
| Coupler EX-1 | 0.002 mol per mol of silver |
| Coupler EX-2 | 0.02 mol per mol of silver |
| Coupler EX-3 | 0.0016 mol per mol of silver |
| Fifth Layer (Intermediate Layer) | |
| Same as the second layer. | |
| Sixth Layer (First Green-Sensitive Emulsion Layer) | |
| Silver iodobromide emulsion | 1.2 g/m$^2$ |

-continued

| | |
|---|---|
| (silver iodide: 4 mol %) | (calculated as silver) |
| Green sensitizing dye (see Table 4) | |
| Coupler EX-4 | 0.05 mol per mol of silver |
| Coupler EX-5 | 0.008 mol per mol of silver |
| Coupler EX-9 | 0.0015 mol per mol of silver |
| Seventh Layer (Second Green-Sensitive Emulsion Layer) | |
| Silver iodobromide emulsion (silver iodide: 8 mol %) | 1.3 g/m$^2$ (calculated as silver) |
| Green sensitizing dye (see Table 4) | |
| Coupler EX-7 | 0.017 mol per mol of silver |
| Coupler EX-6 | 0.003 mol per mol of silver |
| Coupler EX-10 | 0.0003 mol per mol of silver |
| Eighth Layer (Yellow Filter Layer) | |
| Gelatin layer prepared by applying an aqueous gelatin solution containing yellow colloid silver and a dispersion of 2,5-di-tert-octylhydroquinone. | |
| Ninth Layer (First Blue-Sensitive Emulsion Layer) | |
| Silver iodobromide emulsion | 0.7 g/m$^2$ |

-continued

| | |
|---|---|
| (silver iodide: 6 mol %) | (calculated as silver) |
| Coupler EX-8 | 0.25 mol per mol of silver |
| Coupler EX-9 | 0.015 mol per mol of silver |
| Tenth Layer (Second Blue-Sensitive Emulsion Layer) | |
| Silver iodobromide (silver iodide: 6 mol %) | 0.6 g/m$^2$ (calculated as silver) |
| Coupler EX-8 | 0.06 mol per mol of silver |
| Eleventh Layer (First Protective Layer) | |
| Silver iodobromide (silver iodide: 1 mol %; average grain diameter: 0.07 μm) | 0.5 g/m$^2$ (calculated as silver) |
| Gelatin layer containing a dispersion or an ultraviolet absorber, UV-1. | |
| Twelfth Layer (Second Protective Layer) | |
| Prepared by coating a gelatin layer containing polymethyl methacrylate particles (diameter: about 1.5 μm). | |

Each layer contained, as well as the above ingredients, a gelatin hardening agent H and a surface agent (e.g., saponin). The above ingredients are shown below.

Coupler

EX-1

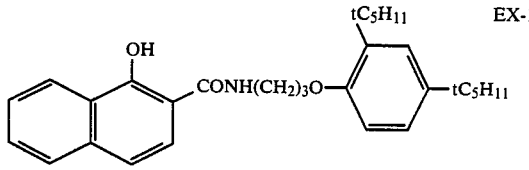

EX-2

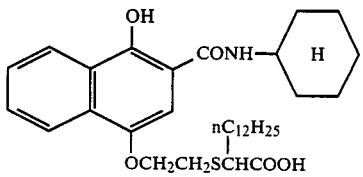

EX-3

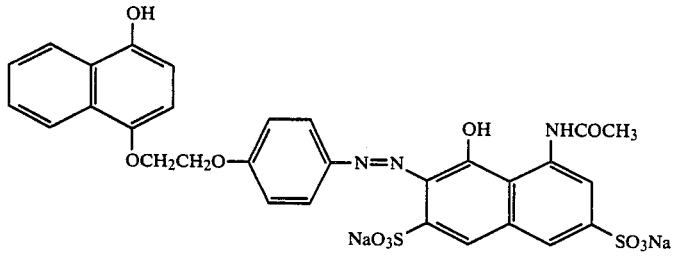

EX-4

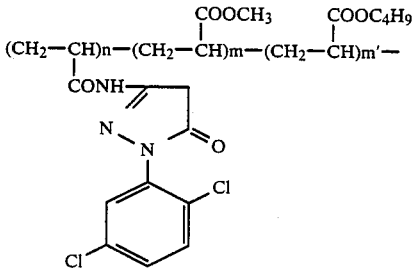

n/m + m' = /(weight ratio) m/m' = /(weight ratio)

Molecular weight: about 4,000

-continued
Coupler
EX-5
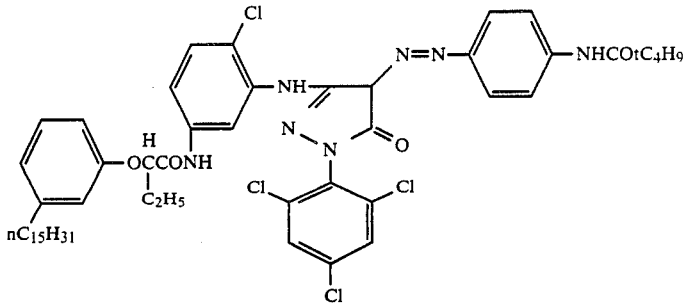
EX-6
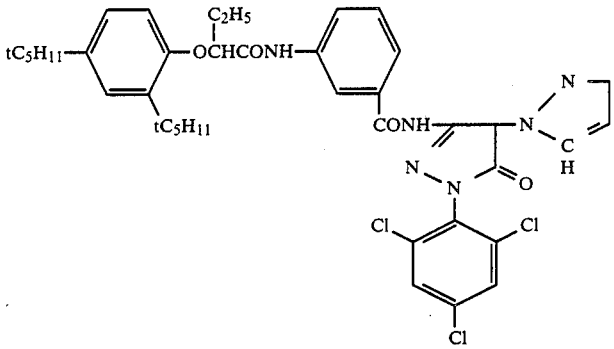
EX-7
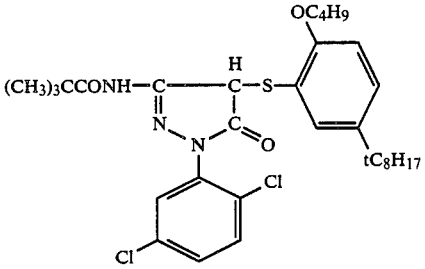
EX-8
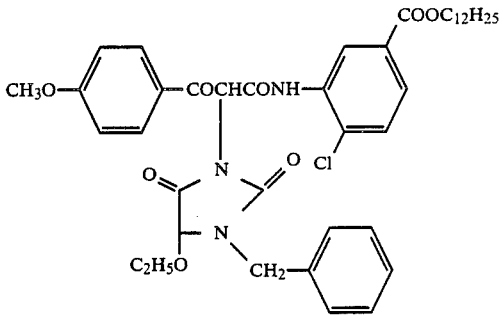
EX-9
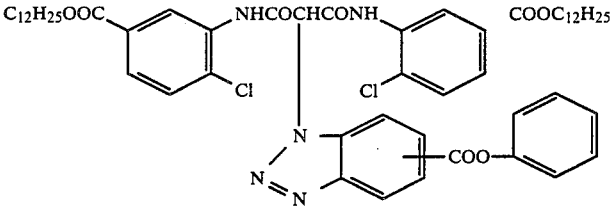
EX-10
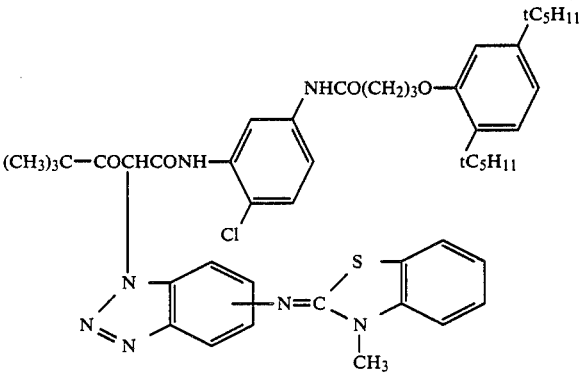

-continued

Coupler

H-1

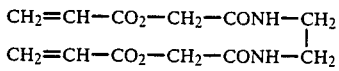

x/y = 7/3 (weight ratio)

UV-1

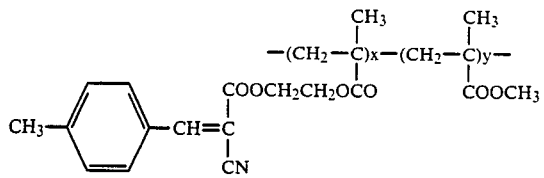

To the third and fourth layers, and the sixth and seventh layers were added sensitizing dyes as shown in Table 4, to prepare light-sensitive materials (Samples 2-1 to 2-4). Half of each sample was exposed to light for 0.02 second at an illumination of 1,000 lux by the use of a light-sensitive meter equipped with a light source having a color temperature of 5,400° K. After exposure, the sample was developed in the manner as described below. The amount of silver remaining in exposed and unexposed areas was measured with a silver amount analyzing apparatus utilizing fluorescent X-rays. The same experiment as above was performed using a bleach-fixing solution containing 0.2 to 0.4 g/l of KI. The results are shown in Table 5.

| Processing Steps | Temperature (°C.) | Time (minutes) |
|---|---|---|
| Color development | 38 | 3.25 |
| Bleach-fixing | 38 | 6 |
| Washing with water | 38 | 3.25 |
| Stabilization | 38 | 3.25 |

-continued

Drying

| Composition of Processing Solution | |
|---|---|
| Color Developer | |
| Sodium nitrilotriacetate | 1.0 g |
| Sodium sulfite | 4.0 g |
| Sodium carbonate | 30.0 g |
| Potassium bromide | 1.4 g |
| Hydroxyamine sulfate | 2.4 g |
| 4-(N—ethyl-N—β-hydroxyethylamino)-2-methylaniline sulfate | 4.5 g |
| Water to make | 1 liter |
| Bleach-Fixing Solution | |
| Iron (III) ammonium ethylenediamine-tetraacetate dihydrate | 100.0 g |
| Disodium ethylenediaminetetraacetate | 5.0 g |
| Aqueous solution of ammonium thio-sulfate (70%) | 200.0 ml |
| Sodium sulfite | 10.0 g |
| Water to make (pH = 6.5) | 1 liter |
| Stabilizer | |
| Formalin (37% formaldehyde solution) | 8 ml |
| Water to make | 1 liter |

TABLE 4

| | Third Layer | Fourth Layer | Sixth Layer | Seventh Layer |
|---|---|---|---|---|
| Sample 2-1 | Dyes (7) of the invention 6.0 mg/m² | Dye (7) of the invention 4.0 mg/m² | Dye (4) of the invention 7.0 mg/m² | Dye (4) of the invention 4.0 mg/m² |
| Sample 2-2 | Dye (7) of the invention 6.0 mg/m² | Dye (7) of the invention 4.0 mg/m² | Green sensitizing dye-B 7.0 mg/m² | Green sensitizing dye-B 4.0 mg/m² |
| Sample 2-3 | Red sensitizing dye-B 6.0 mg/m² | Red sensitizing dye-B 4.0 mg/m² | Dye (4) of the invention 7.0 mg/m² | Dye (4) of the invention 4.0 mg/m² |
| Sample 2-4 | Red sensitizing dye-B 6.0 mg/m² | Red sensitizing dye-B 4.0 mg/m² | Green sensitizing dye B 7.0 mg/m² | Green sensitizing dye B 4.0 mg/m² |

Red sensitizing dye B:

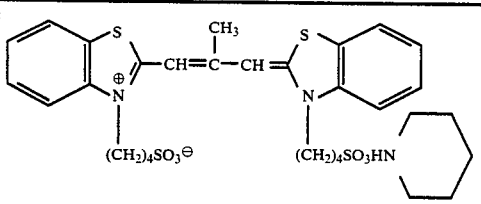

Green sensitizing dye B:

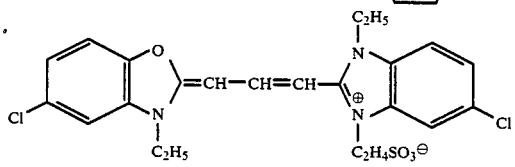

TABLE 5

| | Amount of Residual Silver (μg/cm²) | | | | | |
|---|---|---|---|---|---|---|
| | A | | B | | C | |
| Sample | Unexposed Area | Exposed Area | Unexposed Area | Exposed Area | Unexposed Area | Exposed Area |
| 2-1 | less than 10 | less than 10 | less than 10 | 15 | less than 10 | 25 |
| 2-2 | less than 10 | less than 10 | less than 10 | 20 | less than 10 | 41 |

TABLE 5-continued

| | Amount of Residual Silver ($\mu g/cm^2$) | | | | | |
|---|---|---|---|---|---|---|
| | A | | B | | C | |
| Sample | Unexposed Area | Exposed Area | Unexposed Area | Exposed Area | Unexposed Area | Exposed Area |
| 2-3 | less than 10 | less than 10 | less than 10 | 18 | less than 10 | 32 |
| 2-4 (Comparative Example) | less than 10 | less than 10 | less than 10 | 55 | less than 16 | 125 |

Note:
A: The bleach-fixing solution did not contain KI.
B: The bleach-fixing solution contained 0.2 g/l of KI.
C: The bleach-fixing solution contained 0.4 g/l of KI.

It can be seen from the results of Table 5 that in the light-sensitive samples containing the sensitizing dyes of the present invention, the bleaching speed is excellent even when they are processed with a bleach-fixing solution containing iodide ions.

EXAMPLE 3

A silver chlorobromide photographic emulsion (Br: 60 mol%; Cl: 40 mol%) containing α-(4-palmitamidophenoxy)-α-pivaloyl-4-sulfoamylacetoanilide (described in U.S. Pat. No. 3,408,194) as a yellow dye image-forming coupler was coated on a photographic paper with polyethylene coated thereon to thereby prepare a blue-sensitive emulsion layer. This blue-sensitive emulsion layer contained 4-hydroxy-6-methyl-1,3,3a,7-tetrazaindene as a stabilizer, 2-n-octadecyl-5-(2-sulfo-tert-butyl)hydroquinone potassium salt as an anti-staining agent, and a blue sensitizing agent.

A gelatin intermediate layer containing dioctylhydroquinone was coated on the blue-sensitive emulsion layer.

A green-sensitive silver chlorobromide emulsion (Br; 70 mol%; Cl: 30 mol%) containing 1-phenyl-3-methyl-4-(4-methylsulofnylphenoxy)-5-pyrazolone as a magenta dye image-forming coupler was coated on the intermediate layer to thereby provide a green-sensitive emulsion layer. The coupler was used in the form of a dispersion in tricresyl phosphate (commonly used coupler solvent). The green-sensitive emulsion layer contained dioctylhydroquinone (anti-staining agent) and a green sensitizing dye.

A gelatin layer containing dioctylhydroquinone dispersed in tricresyl phosphate (solvent) was coated on the green-sensitive emulsion layer.

A red-sensitive silver chlorobromide photographic emulsion (Br: 70 mol%; Cl: 30 mol%) containing 1-hydroxy-4-maleimido-2-naphthamide as a cyan dye image-forming coupler was coated on the above-formed gelatin intermediate layer to thereby form a red-sensitive emulsion layer. The coupler contained was dispersed in dibutyl phthalate. The red-sensitive emulsion layer contained dioctylhydrorquinone (anti-staining agent and a red sensitizing dye).

Sensitizing dyes were added to the green-sensitive and red-sensitive emulsion layers as shown in Table 6 to thereby prepare light-sensitive materials (Samples 3-1 to 3-4). Half of each sample was exposed to light for 0.5 second at an illumination of 500 lux by the use of a light-sensitive meter equipped with a light source having a color temperature of 2,854° K. After exposure, the sample was developed in the manner as described below. The amount of silver remaining in exposed and unexposed areas was metered with a silver amount-analyzing apparatus utilizing fluorescent X-rays. The same experiment as above was performed using a bleach-fixing solution containing 0.2 or 0.4 g/l of KI. The results are shown in Table 7.

| Color Developing Steps | Temperature (°C.) | Time (minutes) |
|---|---|---|
| Color development | 30 | 6 |
| Stopping | " | 2 |
| Washing with water | " | 2 |
| Bleach-fixing | " | 1.5 |
| Washing with water | " | 2 |
| Stabilizing bath | " | 2 |
| Drying | | |

Each processing solution had the following composition.

| | |
|---|---|
| **Color Developer** | |
| Benzyl alcohol | 12.0 ml |
| Diethylene glycol | 3.5 ml |
| Sodium hydroxide | 2.0 g |
| Sodium sulfite | 2.0 g |
| Potassium bromide | 0.4 g |
| Sodium chloride | 1.0 g |
| Borax | 4.0 g |
| Hydroxylamine sulfate | 2.0 g |
| Disodium ethylenediaminetetra-acetate dihydrate | 2.0 g |
| 4-Amino-3-methyl-N—ethyl-N—( -methanesulfonamidoethyl)-aniline sesquesulfate monohydrate | 5.0 g |
| Water to make | 1 liter |
| **Stopping Solution** | |
| Ammonium thiosulfate | 10 g |
| Ammonium thiosulfate (70%) | 30 ml |
| Sodium acetate | 5 g |
| Acetic acid | 30 ml |
| Potash alum | 15 g |
| Water to make | 1 liter |
| **Bleach-Fixing Solution** | |
| Ferric sulfate | 20 g |
| Disodium ethylenediaminetetra-acetate dihydrate | 36 g |
| Sodium carbonate monohydrate | 17 g |
| Sodium sulfite | 5 g |
| 70% Aqueous ammonium thiosulfate solution | 100 ml |
| Boric acid | 5 g |
| After adjustment of pH to 6.8, Water to make | 1 liter |
| **Stabilizing Solution** | |
| Boric acid | 5 g |
| Sodium Citrate | 5 g |
| Sodium metaborate tetrahydrate | 3 g |
| Potash alum | 15 g |
| Water to make | 1 liter |

TABLE 6

| Sample | Red-Sensitive Emulsion Layer | | Green Sensitive Emulsion Layer | |
|---|---|---|---|---|
| 3-1 | Dye (11) of the invention | 0.40 mg/m² | Dye (3) of the invention | 0.30 mg/m² |

TABLE 6-continued

| Sample | Red-Sensitive Emulsion Layer | | Green Sensitive Emulsion Layer | |
|---|---|---|---|---|
| 3-2 | Dye (11) of the invention | 0.40 mg/m² | Green sensitizing dye C | 0.30 mg/m² |
| 3-3 | Red sensitizing dye C | 0.40 mg/m² | Dye (3) of the invention | 0.30 mg/m² |
| 3-4 | Red sensitizing dye C | 0.40 mg/m² | Green sensitizing dye C | 0.30 mg/m² |

Red Sensitizing Dye C

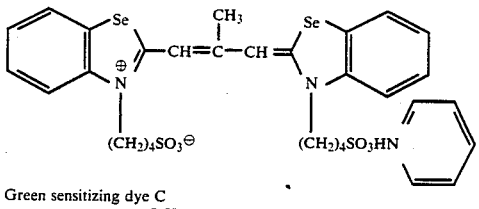

Green sensitizing dye C

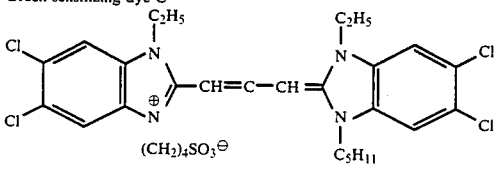

TABLE 7

| Sample | Amount of Residual Silver (μg/cm²) A Unexposed Area | A Exposed Area | B Unexposed Area | B Exposed Area | C Unexposed Area | C Exposed Area |
|---|---|---|---|---|---|---|
| 3-1 | less than 0.1 | less than 0.1 | less than 0.1 | 0.2 | 0.1 | 0.4 |
| 3-2 | " | " | " | 0.4 | 0.2 | 0.6 |
| 3-3 | " | " | " | 0.3 | 0.2 | 0.6 |
| 3-4 (Comparative Example) | " | " | " | 1.0 | 0.5 | 2.2 |

Note:
A: The bleach-fixing solution did not contain KI.
B: The bleach-fixing solution contained 0.2 g/l of KI.
C: The bleach-fixing solution contained 0.4 g/l of KI.

It can be seen from the results of Table 7 that in the light-sensitive materials using the sensitizing dyes of the present invention, the bleaching speed is excellent even when they are processed with a bleach-fixing solution containing iodide ions.

While the invention has been described in detail and with reference to specific embodiments thereof, it will be apparent to one skilled in the art that various changes and modifications can be made therein without departing from the spirit and scope thereof.

What is claimed is:

1. A process for processing a silver halide color photographic material which comprises developing an imagewise exposed light-sensitive material and then bleach-fixing it, wherein the bleach-fixing solution contains iodide ions in an amount exceeding $1.2\times10^{-3}$ gram ion per liter of the solution up to an amount where both bleaching and fixing and desilvering and desilvering effectively proceed, but not greater than an amount of $4.82\times10^{-3}$ gram ion per liter of the solution, and the light-sensitive material contains at least one sensitizing dye selected from the compounds represented by formlae (I), (II), and (III):

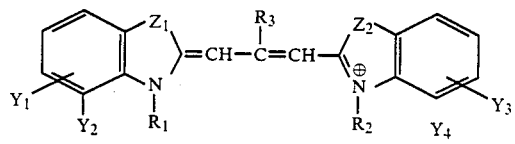

(I)

$(X^{\ominus})n - 1$ wherein $R_1$ and $R_2$ each represents an unsubstituted alkyl group or a substitued alkyl group, $R^3$ represents an alkyl group containing from 1 to 3 carbon atoms or a phenyl group, $Z_1$ and $Z_2$ each represents an oxygen atom, a sulfur atom, or a selenium atom, $Y_1$ represents a phenyl group, or, when $Z_1$ represents a sulfur atom or a selenium atom, $Y_1$ represents a phenyl group or a chlorine atom, $Y_3$ represents a phenyl group, an alkyl group, an alkoxyl group, or a chlorine atom, $Y_2$ and $Y_4$ each represents a hydrogen atom, or $Y_1$ and $Y_2$ combine together to form a benzene ring or $Y_3$ and $Y_4$ combine together to form a benzene ring, X represents an acid anion, and n is 1 or 2;

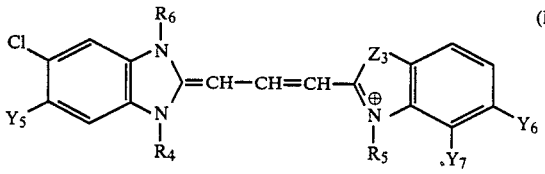

(II)

$(X^{\ominus})n - 1$ wherein $R_4$ and $R_5$ each represents an unsubstituted alkyl group or a substituted alkyl group, $R_6$ represents an alkyl group containing from 1 to 2 carbon atoms, $Z_3$ represents an oxygen atom, a sulfur atom, or a selenium atom, $Y_5$ represents a chlorine atom, a fluorine atom, or a cyano group, $Y_6$ represents a phenyl group, $Y_7$ represents a hydrogen atom, or $Y_6$ and $Y_7$ combine together to form a benzene ring, X is an acid anion, and n is 1 or 2;

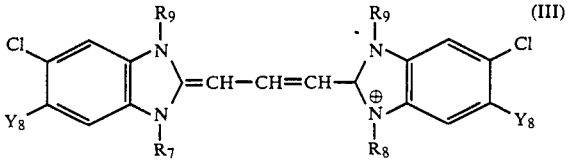

(III)

$(X^{\ominus})n - 1$ wherein $R_7$ and $R_8$ each represents an unsubstituted alkyl group or a substituted alkyl group, $R_9$ represents an alkyl group having 1 to 2 carbon atoms, $Y_8$ is a chlorine atom or a cyano group, X is an acid anion, and n is 1 or 2.

2. A process as in claim 1, wherein the iodide ion content of the bleach-fixing solution is in excess of $2.4\times10^{-3}$ gram ion/liter.

3. A process as in claim 1, wherein the bleach-fixing solution contains a bleach-accelerating agent.

4. A process as in claim 1, wherein the light-sensitive material comprises at least three layers, including a blue-sensitive emulsion layer, a green-sensitive emulsion layer, and a red-sensitive emulsion layer.

5. A process as in claim 1, wherein at least one emulsion layer of the light-sensitive material contains at least one of a yellow coupler, a magenta coupler, and a cyan coupler.

6. A process as in claim 1, wherein $R_1$, $R_2$, $R_4$, $R_5$, $R_7$, and $R_8$ each represents an unsubstituted alkyl group containing 8 or less carbon atoms or a substituted alkyl group wherein the alkyl moiety contains 6 or less carbon atoms, and the substituents of the substituted alkyl group are selected from the group consisting of a carboxyl group, a sulfo group, a cyano group, a halogen atom, a hydroxyl group, an alkoxycarbonyl group containing 8 or less carbon atoms, an alkyoxyl group containing 7 or less carbon atoms, an aryloxy group, an acyloxy group containing 3 or less carbon atoms, an acyl group containing 8 or less carbon atoms, a carbamoyl group, a sulfamoyl group, and an aryl group.

7. A process as in claim 6, wherein at least one of $R_1$ and $R_2$ in formula (I), at least of $R_4$ and $R_5$ in formula (II), and at least one of $R_6$ and $R_7$ in formula (III) represents a substituted alkyl group in which the substituent contains a sulfo group or a carboxyl group.

8. A process as in claim 2, wherein $R_1$, $R_2$, $R_4$, $R_5$, $R_7$, and $R_8$ each represents an unsubstituted alkyl group containing 8 or less carbon atoms or a substituted alkyl group wherein the alkyl moiety contains 6 or less carbon atoms, and the substituents of the substituted alkyl group are selected from the group consisting of a carboxyl group, a sulfo group, a cyano group, a halogen atom, a hydroxyl group, an alkoxycarbonyl group containing 8 or less carbon atoms, an alkyoxyl group containing 7 or less carbon atoms, an aryloxy group, an acyloxy group containing 3 or less carbon atoms, an acyl group containing 8 or less carbon atoms, a carbamoyl group, a sulfamoyl group, and an aryl group.

9. A process as in claim 8, wherein at least one of $R_1$ and $R_2$ in formula (I), at least one of $R_4$ and $R_5$ in formula (II), and at least one of $R_7$ and $R_8$ in formula (III) represents a substituted alkyl group in which the substituent contains a sulfo group or a carboxyl group.

10. A process as in claim 1, wherein both $R_1$ and $R_2$ in formula (I), both $R_4$ and $R_5$ in formula (II) and both $R_7$ and $R_8$ in formula (III) represent a substituted alkyl group in which the substituent contains a sulfo group or a carboxyl group.

11. A process as in claim 1, wherein the bleach-fixing solution contains a complex salt of ferric ion and ethylene diamine tetraacetic acid as a bleaching agent.

12. A process as in claim 1, wherein the development is carried out at 30° C. to 50° C.

13. A process as in claim 1, wherein the development is carried out at 38° C. to 50° C.

14. A process as in claim 1, wherein the silver halide color photographic material is a color paper or a color reversal paper.

* * * * *